US007584581B2

(12) United States Patent
Iske

(10) Patent No.: US 7,584,581 B2
(45) Date of Patent: Sep. 8, 2009

(54) DEVICE FOR POST-INSTALLATION IN-SITU BARRIER CREATION AND METHOD OF USE THEREOF

(76) Inventor: Brian Iske, 86 Spindlewick Dr., Nashua, NH (US) 03062

( * ) Notice: Subject to any disclaimer, the term of this patent is extended or adjusted under 35 U.S.C. 154(b) by 589 days.

(21) Appl. No.: 11/066,927

(22) Filed: Feb. 25, 2005

(65) Prior Publication Data

US 2006/0191224 A1 Aug. 31, 2006

(51) Int. Cl.
*E04B 1/16* (2006.01)
*E04B 1/18* (2006.01)
*E02D 5/00* (2006.01)

(52) U.S. Cl. ..... 52/380; 52/414; 405/222

(58) Field of Classification Search ..... 52/169.14, 52/414, 415, 741.4, 514, 742.1, 380, 404.1, 52/749.1; 405/222, 233, 263–270
See application file for complete search history.

(56) References Cited

U.S. PATENT DOCUMENTS 741,589 A * 10/1903 McBean ..... 52/514
2,263,070 A * 11/1941 Cusick ..... 52/742.13
2,357,769 A * 9/1944 Rushmer ..... 405/269
3,099,911 A * 8/1963 Turzillo ..... 405/266
3,137,601 A * 6/1964 Menzer ..... 156/276
RE25,614 E * 7/1964 Turzillo ..... 405/266
3,780,975 A * 12/1973 Turzillo ..... 249/1
3,844,527 A 10/1974 Scott
3,969,852 A 7/1976 Krings
3,973,408 A * 8/1976 Paverman ..... 405/267

(Continued)

FOREIGN PATENT DOCUMENTS

DE 2324097 A1 2/1974

(Continued)

OTHER PUBLICATIONS

Egger, et al., "Achieving Dry Stations and Tunnels with Flexible Waterproofing Membranes," Mar. 2, 2004 (found at http://dr-sauer.com).

(Continued)

*Primary Examiner*—Richard E Chilcot, Jr.
*Assistant Examiner*—Andrew J Triggs
(74) *Attorney, Agent, or Firm*—James E. Huson, III; Crain, Caton & James, P.C.

(57) ABSTRACT

The present invention relates to a device for post-installation in-situ barrier creation. A multi-layered device provides a medium for of remedial substances such as waterproofing resins or cements, insecticides, mold preventatives, rust retardants and the like. The multi-layer device preferably consists of three conjoined layers: first layer, intermediate layer, and second layer, and at least one piping. The first layer is preferably semi-permeable; the second layer is a non-permeable layer; the intermediate layer is a void-inducing layer. The second layer, intermediate layer, and first layer are fixedly attached, with the intermediate layer interposed between the second layer and the first layer. The multi-layered device is fixedly attached to shoring system exterior surface. At least one piping is engagedly attached to a panel of the multi-layered device. A structural construction material is constructed exterior the multi-layer device. Thereafter, a free flowing substance can be pumped to the multi-layered device.

12 Claims, 5 Drawing Sheets

U.S. PATENT DOCUMENTS 3,984,989 A * 10/1976 Turzillo ..... 405/222
4,110,151 A * 8/1978 Morse ..... 156/519
4,134,242 A 1/1979 Musz et al.
4,177,618 A * 12/1979 Felter ..... 52/742.13
4,259,028 A 3/1981 Cook
4,370,078 A * 1/1983 Gadelle et al. ..... 405/264
4,386,876 A * 6/1983 Dupeuble ..... 405/259.5
4,391,555 A * 7/1983 Burger et al. ..... 405/264
4,391,556 A * 7/1983 Burger et al. ..... 405/264
4,543,016 A * 9/1985 Tallard ..... 405/267
4,563,852 A * 1/1986 Achtenberg et al. ..... 52/742.14
4,623,283 A * 11/1986 Chew ..... 405/270
4,712,347 A * 12/1987 Sperber ..... 52/404.1
4,730,805 A * 3/1988 Yokota et al. ..... 249/113
4,754,590 A * 7/1988 Gordon ..... 52/741.4
4,787,597 A 11/1988 Yokota et al.
4,905,441 A * 3/1990 Landers ..... 52/514
4,927,297 A * 5/1990 Simpson ..... 405/270
5,201,612 A * 4/1993 Gadelle et al. ..... 405/264
5,245,812 A * 9/1993 Landers ..... 52/514
5,263,795 A * 11/1993 Corey et al. ..... 405/128.25
5,287,674 A * 2/1994 Sperber ..... 52/742.13
5,365,716 A * 11/1994 Munson ..... 52/742.13
5,385,504 A 1/1995 Hussey et al.
5,450,700 A * 9/1995 Hackman ..... 52/425
5,725,327 A 3/1998 Hussey et al.
5,792,552 A * 8/1998 Langkamp et al. ..... 428/309.9
5,819,496 A * 10/1998 Sperber ..... 52/742.13
5,842,519 A * 12/1998 Sydansk ..... 166/295
5,891,549 A 4/1999 Beretta et al.
5,911,539 A 6/1999 Egan et al.
6,202,370 B1 * 3/2001 Miller et al. ..... 52/169.14
6,290,021 B1 * 9/2001 Strandgaard ..... 181/290
6,588,986 B1 * 7/2003 Sibilla ..... 405/259.5
6,655,107 B2 * 12/2003 Dean ..... 52/742.14
6,662,516 B2 * 12/2003 Vandehey et al. ..... 52/407.1
6,691,472 B2 * 2/2004 Hubert ..... 52/169.5
6,976,804 B1 * 12/2005 Asplin ..... 404/78
7,032,660 B2 * 4/2006 Vinegar et al. ..... 166/245
7,077,198 B2 * 7/2006 Vinegar et al. ..... 166/245
2002/0157344 A1 * 10/2002 Dean ..... 52/742.1
2003/0161691 A1 * 8/2003 Marshall ..... 405/233
2004/0168802 A1 * 9/2004 Creel et al. ..... 166/293
2004/0200173 A1 * 10/2004 Drake ..... 52/514.5
2006/0010826 A1 * 1/2006 Canteri ..... 52/741.4

FOREIGN PATENT DOCUMENTS

DE 2841452 * 3/1980
DE 2841452 A1 3/1980
EP 1267035 A1 12/2002
WO WO/2005/040555 A1 5/2005

OTHER PUBLICATIONS

Young, Lee W., International Search Report PCT/US06/06693, Nov. 6, 2007, United States Patent and Trademark Office As International Search Authority, 10 pages, Alexandria, Virginia, USA.

Danissen, Paulina, International Search Report PCT/US06/34079, Jul. 17, 2007, European Patent Office as International Search Authority, 10 pages, Rijswijk, The Netherlands.

Various web site information on drainage mats (including SuperDrain, Enkadrain, Terradrain, Senergy, Tenax, Ultradrain, AmerDrain, J-Drain, Fondavis, Ruble, Terram, and Mirafi drainage mats), 2006.

Seidel, Marianne, International Preliminary Report on Patentability—PCT/US06/06693, Jul. 25, 2008, 11 pages, USPTO as International Searching Authority, Alexandria, Virginia, US.

Abraham I. Holczer, Translation—DE 2841452A1, Aug. 25, 2008, 11 pages, New York, New York, USA.

Copy and translation of office action in RU 2007135350 (national phase of PCT/US2006/006693, claiming priority to parent application U.S. Appl. No. 11/086,927), filed Jan. 29, 2009, 22 pages, Russian Patent Office.

* cited by examiner

DEVICE FOR POST-INSTALLATION IN-SITU BARRIER CREATION AND METHOD OF USE THEREOF

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

Field of the Invention

The present invention relates to a device for post-installation in-situ barrier creation, and more particularly to a multi-layered device providing a medium for post-installation injection of remedial substances such as waterproofing resins or cements, insecticides, mold preventatives, rust retardants and the like.

It is common in underground structures, such as tunnels, mines and large buildings with subterranean foundations, to require that the structures be watertight. Thus, it is essential to prevent groundwater from contacting the porous portions of structures or joints, which are typically of concrete. It is also essential to remove water present in the voids of such concrete as such water may swell during low temperatures and fracture the concrete or may contact ferrous portions of the structure, resulting in oxidation and material degredation. Therefore, devices have been developed for removing water from the concrete structure and for preventing water from contacting the concrete structure.

Attempts at removing groundwater from the concrete structure have included a permeable liner and an absorbent sheet. Both absorb adjacent water, carrying it from the concrete structure. This type is system is limited, however, because it cannot introduce a fluid or gaseous substance to the concrete and as the water removed is only that in contact with the system. Additionally, this system does not provide a waterproof barrier.

Among attempts at preventing water from contacting the concrete structure has been the installation of a waterproof liner between a shoring system and the concrete form. This method fails if the waterproof liner is punctured with rebar or other sharp objects, which is common at construction sites. In such an occurrence, it may be necessary for the concrete form to be disassembled so a new waterproof liner may be installed. Such deconstruction is time consuming and expensive. It would therefore be preferable to install a system that provides a secondary waterproof alternative, should the initial waterproof layer fail. Additionally, attempts at preventing water from contacting a concrete structure have included installation of a membrane that swells upon contact with water. While this type of membrane is effective in absorbing the water and expanding to form a water barrier, this type of membrane is limited in its swelling capacity. Therefore, it would be preferable to provide a system that is unlimited in its swelling capacity by allowing a material to be added until the leak is repaired.

Another attempt to resolving this problem was disclosed in "Achieving Dry Stations and Tunnels with Flexible Waterproofing Membranes," published by Egger, et al. on Mar. 2, 2004 discloses a flexible membrane for waterproofing tunnels and underground structures. The flexible membrane includes first and second layers, which are installed separately. The first layer is a nonwoven polypropylene geotextile, which serves as a cushion against the pressure applied during the placement of the final lining where the membrane is pushed hard against the sub-strata. The first layer also transports water to the pipes at the membrane toe in an open system. The second layer is commonly a polyvinyl chloride (PVC) membrane or a modified polyethylene (PE) membrane, and is installed on top of the first layer. The waterproof membrane is subdivided into sections by welding water barriers to the membrane at their base. Leakage is detected through pipes running from the waterproof membrane to the face of the concrete lining. The pipes are placed at high and low points of each subdivided section. If leakage is detected, a low viscosity grout can be injected through the lower laying pipes. However the welding and the separate installation of the first and second layers make this waterproof system difficult to install, thus requiring highly skilled laborers.

It would therefore be advantageous to provide an in-situ multi-layered device for post-installation concrete sealing, and more particularly a providing a medium for post-installation injection of waterproofing resin.

BRIEF SUMMARY OF THE INVENTION

One object of the invention is to provide a single application which includes a first layer providing an initial waterproof surface. Another object of the invention is to provide a secondary, remedial layer that is operable should the first layer fail. A further object of the invention is to provide that such multi-layer system be quickly and easily installed. An additional object of the present invention allows selective introduction of a fluid substance to specific areas of a structure.

Accordingly, it is an object of the present invention to provide a dual-layered layer that:

- has a waterproof layer providing a first level of protection from water penetration
- has a second, remedial protection from water penetration through delivering a fluid substance to a structure
- allows the introduction of a fluid substance in situ
- allows selective introduction of a fluid substance to specific areas of a structure
- affixable to a variety of surfaces
- easily and quickly installable Other features and advantages of the invention will be apparent from the following description, the accompanying drawing and the appended claims.

DESCRIPTION OF THE INVENTION

Figure 1:
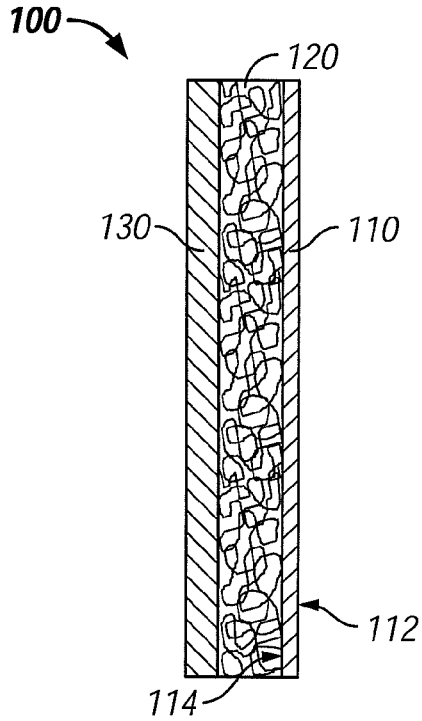
FIG. 1 is a cross sectional view of the preferred embodiment of fluid delivery system.

FIG. 1 depicts the preferred embodiment of substance delivery system 100. Substance delivery system 100 is a multi-layer system for delivering substances to a structure, in situ, wherein the multi-layer system has at least two layers. In the preferred embodiment, substance delivery system 100 consists of three conjoined layers: first layer 130, intermediate layer 120, and second layer 110, and at least one piping 150 (shown in FIG. 6). While the preferred embodiment of the invention consists of three layers joined together, alternate multiple-layer configurations are possible.

First layer 130 is preferably semi-permeable. In the preferred embodiment of the invention, first layer 130 should be made of a material suitable for permeating fluids therethrough, while prohibiting passage of concrete or other similar structural construction materials. A polypropylene or polyethylene non-woven geotextile is suitable. Additionally, other materials known in the art may be preferable depending on the particular application.

Second layer 110 is a non-permeable layer that is preferably waterproof and self-sealing. Second layer 110 can be an asphalt sheet, or other like material known in the art. Second layer 110 may have an adhesive affixed to second layer interior side 114, second layer exterior side 112, or both sides 112 and 114. Adhesive on second layer interior side 114 permits joining of adjacent panels of substance delivery system 100. Adhesive on second layer exterior 112 aids in affixing substance delivery system 100 to shoring system 20 (seen in FIGS. 4 and 5).

Intermediate layer 120 is a void-inducing layer, conducive to permitting a free-flowing substance to flow throughout substance delivery system 100. Intermediate layer 120 may be formed by an open lattice of fibers of sufficient rigidity to maintain the presence of the void when an inward force is exerted against substance delivery system 100. A polypropylene lattice or other similarly rigid material is preferable. The presence of intermediate layer 120 permits the channeling of free-flowing substances through substance delivery system 100. Intermediate layer 120 either channels water away from structural construction material 200, or provides a medium for transporting a free-flowing substance to structural construction material 200.

Figure 2:
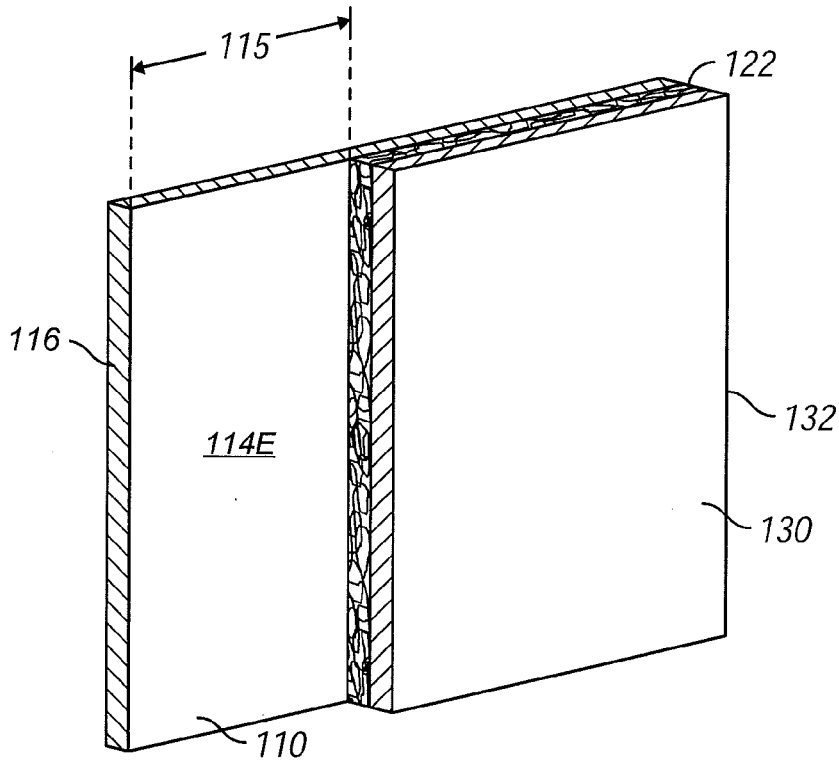
FIG. 2 is an isometric view of fluid delivery system with interlinking extension.

Referring to FIG. 2, second layer 110, intermediate layer 120, and first layer 130 are fixedly attached, with intermediate layer 120 interposed between second layer 110 and first layer 130. Second layer 110, intermediate layer 120, and first layer 130 are each defined by a plurality of sides, respectively forming second layer perimeter 116, intermediate layer perimeter 122, and first layer perimeter 132. In the preferred embodiment, intermediate layer perimeter 122 and first layer perimeter 132 are dimensionally proportional, such that permeable layer perimeter 122 and semi-permeable layer perimeter 132 are equivalently sized. Intermediate layer 120 and first layer 130 have a first width that extends horizontally across the layers. Second layer perimeter 116 is partially proportional to intermediate layer perimeter 122 and first layer perimeter 132, such that at least two sides of second layer perimeter 116 are equivalently sized to the corresponding sides of intermediate layer perimeter 122 and first layer perimeter 132. Second layer 110 has a second width that extends horizontally across second layer 110. The second width of second layer 110 is greater than the first width of intermediate layer 120 and first layer 130. Thus, referring to FIGS. 2 and 3, when the bottom edges of first layer 130, intermediate layer 120, and second layer 110 are aligned, a second layer extension 114E outwardly extends an extension distance 115 from at least one side of first layer 130 and intermediate layer 120. Second layer extension 114E provides an underlay for installing substance delivery system 100 thereupon, thereby eliminating potential weakness at the splice where panels of substance delivery system 100 abut.

Figure 4:
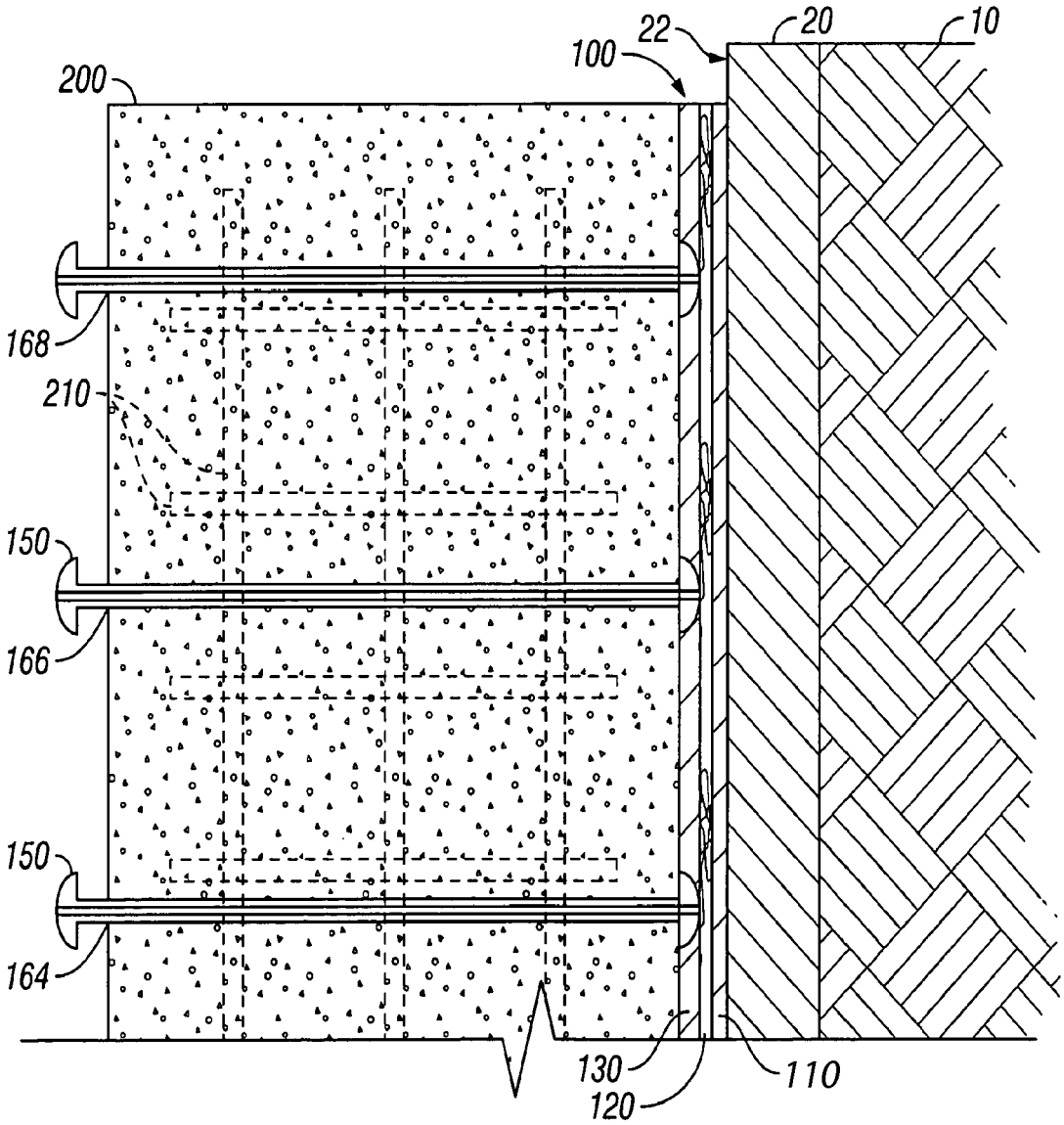
FIG. 4 is a side view of fluid delivery system installed between rebar matrix and shoring system.
Figure 5:
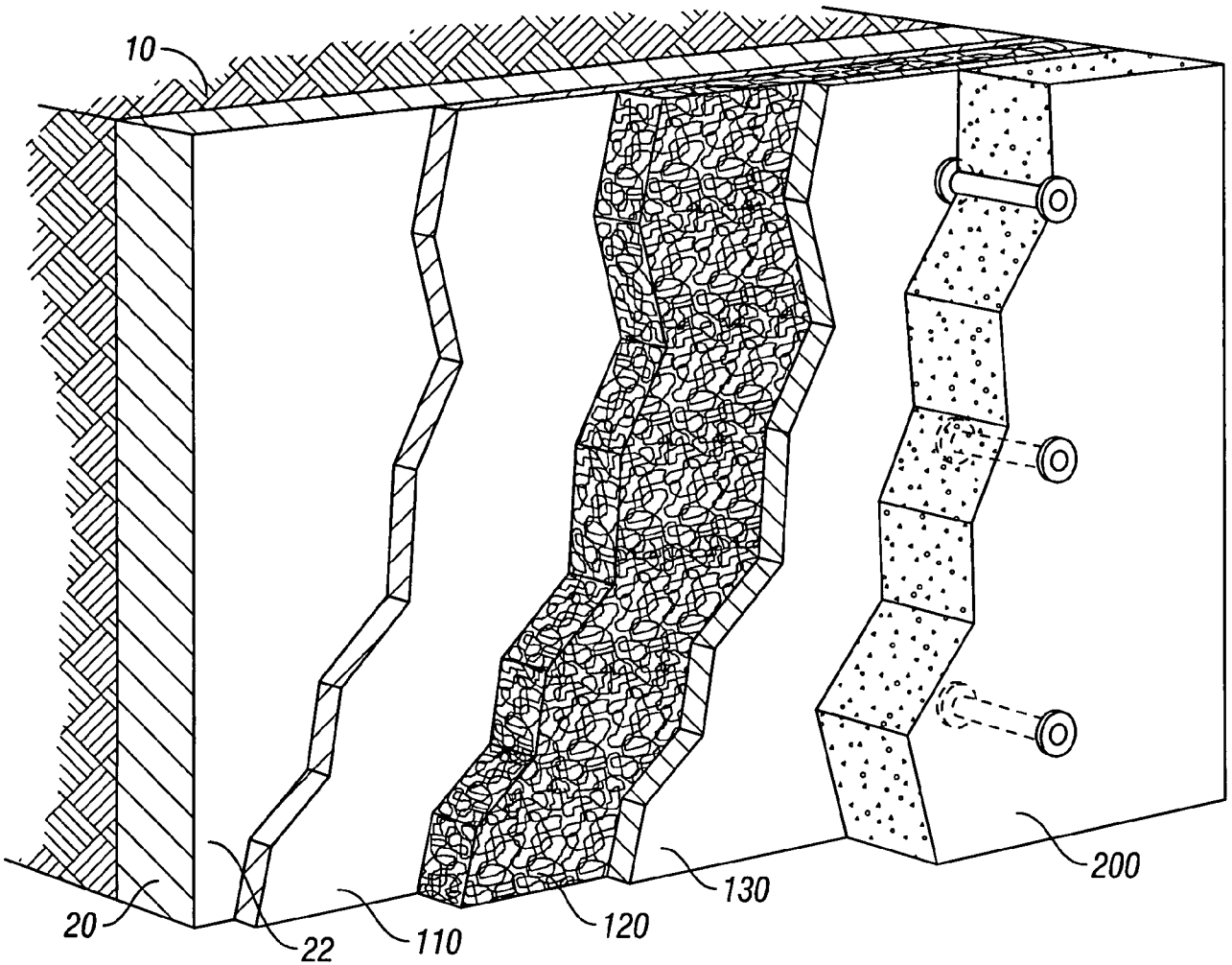
FIG. 5 is a side view of fluid delivery system installed between concrete structure and shoring system.

In the preferred embodiment, seen in FIGS. 4 and 5, shoring system 20 is installed to retain earth 10 when a large quantity of soil is excavated. Shoring system 20 includes common shoring techniques such as I-beams with pilings and shotcrete. Substance delivery system 100 is fixedly attached to shoring system exterior surface 22. As previously discussed, substance delivery system 100 can be attached to shoring system exterior surface 22 by applying an adhesive to second layer exterior side 112 and affixing second layer exterior side 112 to shoring system exterior surface 22. Alternatively, substance delivery system 100 can be attached to shoring system exterior surface 22 by driving nails, or other similar attachment means, through substance delivery system 100 and into shoring system 20. In the preferred embodiment second layer 110 is self-sealing. Thus, puncturing second layer 110 with a plurality of nails will negligibly affect second layer's 110 ability to provide a waterproof barrier.

Figure 3:
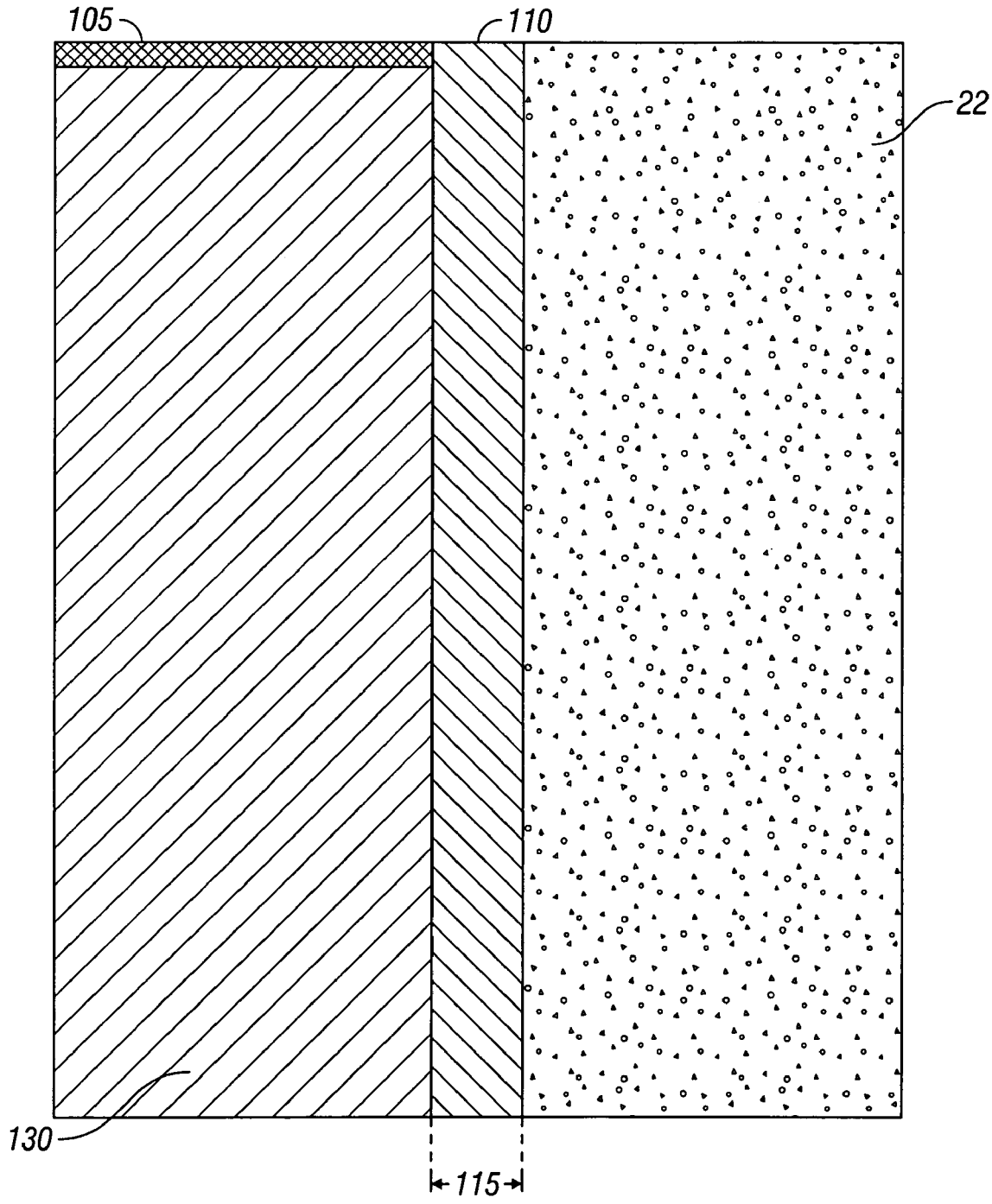
FIG. 3 is a front view of a plurality of fluid delivery systems installed onto a shoring system.
Figure 6:
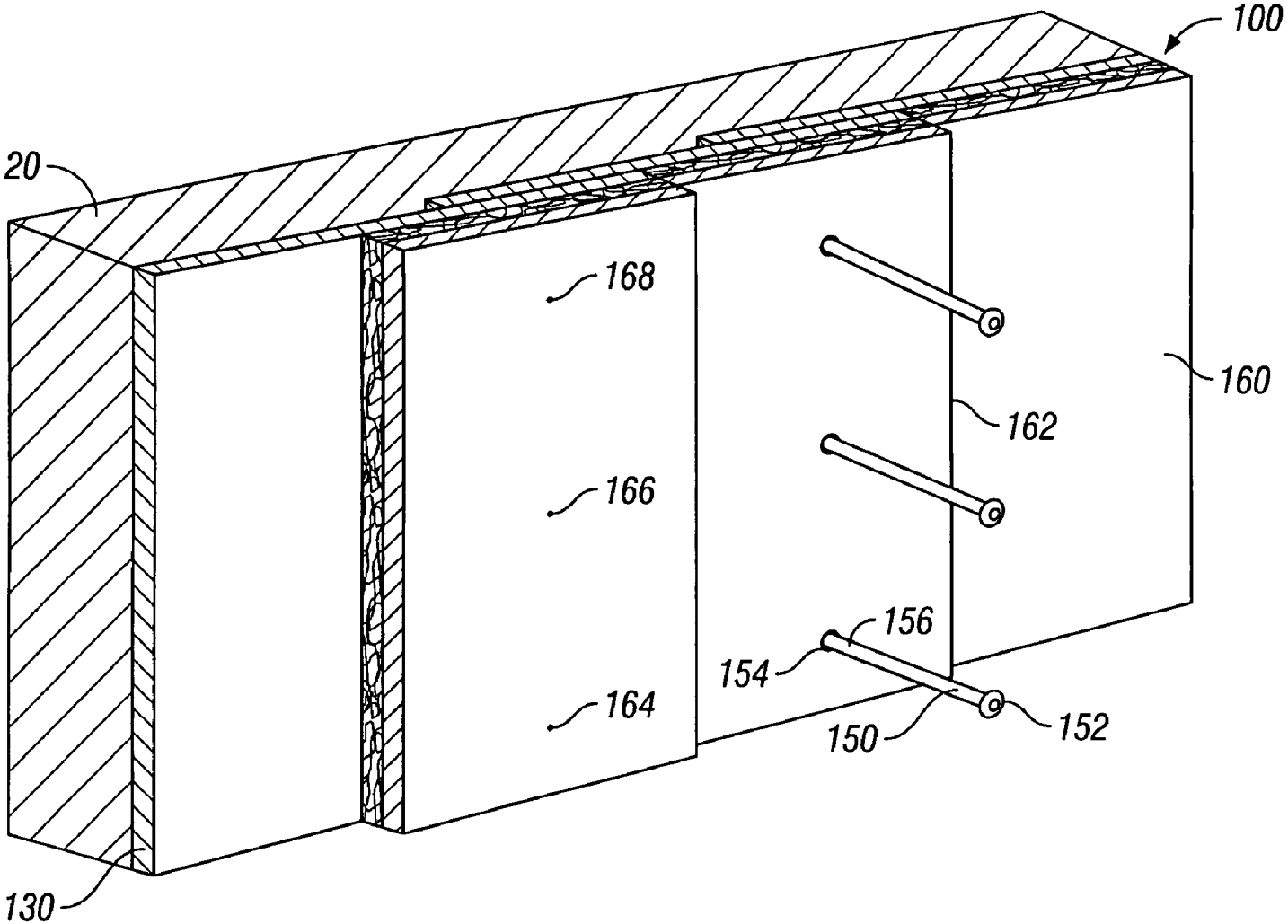
FIG. 6 is an isometric view of compartmentalized fluid delivery system with fluid dispensing mechanisms attached.

Referring to FIGS. 3 and 6, substance delivery system 100 canvases shoring system exterior surface 22. Substance delivery system 100 can be cut to any size, depending on the application. If a single substance delivery system 100 does not cover the desired area, a plurality of panels of substance delivery system 100 are used in concert to provide waterproof protection. As previously discussed, substance delivery system 100 may include second layer extension 114E for reinforcement at the abutment between adjacent panels of substance delivery system 100. Thus, a first panel of substance delivery system 100 is fixedly attached to shoring system exterior surface 22, with second layer extension 114E extending outwardly onto shoring system exterior surface 22. A second panel of substance delivery system 100 overlays second layer extension 114E of the first panel of substance delivery system 100, thereby interlinking the first and second panels of substance delivery system 100. This process is repeated until the plurality of panels of substance delivery system 100 blanket shoring system exterior surface 22. The area of overlap between to adjacent panels of substance delivery system 100 preferably extends vertically. The upper terminal end of substance delivery system 100, proximate the upper edge of the constructed form (not shown), is sealed with sealing mechanism 105. Sealing mechanism 105 prevents the injected fluid from being discharged through the top of substance delivery system 100. Sealing mechanism 105 may be a clamp or other similar clenching device for sealing the upper terminal end of substance delivery system 100.

Referring to FIG. 6, division strip 162 is fixedly attached in a vertical orientation between the junction points of adjacent substance delivery systems 100. In the preferred embodiment division strip 162 has an adhesive surface, thereby allowing division strip 162 to be quickly and safely installed. Alternatively, division strip 162 may be installed by driving a plurality of nails, or similar attaching means, through division strip 162. First layer extension 114 may be of such width as to accommodate division strip 162 and still permit joining to an adjacent panel of substance delivery system 100.

Division strip 162 is preferably comprised of a material that swells upon contact with water. When water interacts with division strip 162, division strip 162 outwardly expands, thereby eliminating communication between the abutting substance delivery systems 100. Thus, division strip 162 compartmentalizes each panel of substance delivery system 100. Compartmentalization enables selective injection of a fluid or gas into a predetermined panel of substance delivery system 100. Alternatively, division strip 162 is formed from a non-swelling material. When division strip 162 is non-swelling, the structural construction material 200 forms around division strip 162, thereby filling in any voids and forming a seal between adjacent substance delivery systems 100.

Referring to FIGS. 4 and 6, at least one piping 150 is engagedly attached to a panel of substance delivery system 100. Piping 150 is tubular, with inlet 152, outlet 154, and cylinder 156 extending therebetween. A plurality of teeth (not shown) outwardly extend from outlet 154, and engage first layer 130 as to permit injection of fluid into first layer 130 through to intermediate layer 120. Cylinder 156 extends through rebar matrix 210, with inlet 152 terminating exterior the structural construction material form (not shown). Cylinder 156 can be secured to rebar matrix 210 through ties, clamps, or other similar means of attachment. The number of piping 150 necessary is dependent on the size of chamber 160. In the preferred embodiment of the invention, piping 150 should be positioned at lower point 164, mid point 166, and upper point 168.

In the preferred embodiment depicted in FIG. 4, a structural construction material 200 is inserted into form (not shown). The structural construction material 200 can be concrete, plaster, stoneware, cinderblock, brick, wood, plastic, foam or other similar synthetic or natural materials known in the art. Second layer 110 of substance delivery system 100 provides the primary waterproof defense. If it is determined that second layer 110 has been punctured or has failed, resulting in water leaking to structural construction material 200, a free flowing substance can be pumped to the panel of substance delivery system 100 located proximate the leak. The free flowing substance is introduced to such panel of substance delivery system 100 via piping 150 in an upward progression, wherein the free flowing substance is controllably introduced to lower point 164 of panel of substance delivery system 100, then to mid point 166 of panel of substance delivery system 100, and then to upper point 168 of panel of substance delivery system 100. A dye may be added to the free flowing substance, allowing for a visual determination of when to cease pumping the free flowing substance to panel of substance delivery system 100. When the dye in the free flowing substance leaks out of structural construction material 200, thereby indicating that the selected substance delivery system 100 is fully impregnated, pumping is ceased.

First layer 130 permeates the free flowing substance into the space between first layer 130 and structural construction material 200. When the free flowing substance is a hydrophilic liquid, the free flowing substance interacts with any water present, thereby causing the free flowing substance to expand and become impermeable, creating an impenetrable waterproof layer. Thus, a secondary waterproof barrier can be created if a failure occurs in second layer 110.

Alternatively, different free flowing substances may be introduced to substance delivery system 100, depending on the situation. If the integrity of structural construction material 200 is compromised, a resin for strengthening structural construction material 200 can be injected into substance delivery system 100 to repair structural construction material 200. Alternatively, a gas may be injected into substance delivery system 100 for providing mold protection, rust retardation, delivering an insecticide, or other similar purposes.

In a separate and distinct embodiment of the invention, intermediate layer 120 may be completely replaced with first layer 130.

In a separate and distinct embodiment of the invention, substance delivery system 100 is directly attached to the earth, such as in a tunnel or mine. In this embodiment, substance delivery system 100 is inversely installed on tunnel surface (not shown). First layer 130 faces tunnel surface and second layer 110 inwardly faces tunnel space. Substance delivery system 100 can be fixedly attached by applying an adhesive to first layer 130, driving nails through substance delivery system 100, or similar attaching means known in the art. Substance delivery system 100 is installed in vertical segments, similar to the method described above for the preferred embodiment. However, the plurality of piping 150 is not necessary in the alternative embodiment.

Once substance delivery system 100 is installed on tunnel surface, the structural construction material 200 can be installed directly onto second layer 110.

In the alternative embodiment (not shown) should a failure occur in substance delivery system 100, an operator can drill a plurality of holes through the structural construction material 200, ceasing when second layer 110 is penetrated. Such holes would provide fluid access to intermediate layer 120. A fluid substance (not shown) would then be pumped through the holes, thereby introducing the fluid substance to intermediate member 120. Intermediate layer 120 channels the fluid substance throughout substance delivery system 100, ultimately permitting first layer 130 to permeate the fluid substance therethrough.

The foregoing description of the invention illustrates a preferred embodiment thereof. Various changes may be made in the details of the illustrated construction within the scope of the appended claims without departing from the true spirit of the invention. The present invention should only be limited by the claims and their equivalents.

What is claimed is:

1. A device for introducing a free-flowing permeating substance to a structure in situ, the structure having thickness, said device comprising:

a first layer, said first layer being permeable to said free-flowing permeating substance but at least nearly impermeable to structural construction materials, said first layer adapted for placement adjacent said structure, said first layer adapted to communicate with said structure to permit introduction of said free-flowing permeating substance to said structure;

a second layer, said second layer being impermeable, said second layer having a first side and a second side;

at least one piping adapted to pass through said structure, said piping adapted for communication with said first layer to permit injection of said free-flowing permeating substance into said first layer, said piping having an inlet adapted for placement exterior said structure and constructed to permit communication with a source of said free-flowing permeating substance;

said free-flowing permeating substance comprises at least one selection from the group consisting of a liquid and a gas;

an intermediate layer composed of a material permeable to said free-flowing permeating substance; and said intermediate layer intermediate said first layer and said second layer.

2. The device of claim 1, wherein said device further comprises:

said intermediate layer comprises a plurality of sufficiently rigid fibers.

3. The device of claim 2, wherein said device further comprises:

said first layer of a first width;

said first layer having a first layer first side edge;

said intermediate layer of said first width;

said intermediate layer having an intermediate layer first side edge, said second layer of a second width, said second layer having a second layer first side edge;

said second width greater than said first width; and said first layer first side edge, said intermediate layer first side edge and said second layer first side edge being aligned.

4. The device of claim 3, wherein said device further comprises:

said at least one piping comprises a first piping;

said first layer having a first layer bottom edge;

said first piping located proximate said first layer bottom edge;

said first layer having a top edge; and a second piping being located proximate said first layer top edge.

5. The device of claim 4, wherein said device further comprises:

a third piping located between said first layer bottom edge and said first layer top edge.

6. The device of claim 2, wherein said sufficiently rigid fibers are of sufficient rigidity to maintain a void between said first layer and said second layer.

7. A device for introducing a free-flowing permeating substance to a structure in situ, the structure having thickness, said device comprising:

a first layer, said first layer being permeable to said free-flowing permeating substance but at least nearly impermeable to structural construction materials, said first layer of a first width, said first layer having a first layer first side edge, said first layer adapted for placement adjacent said structure, said first layer adapted to communicate with said structure to permit introduction of said free-flowing permeating substance to said structure;

a second layer, said second layer being impermeable, said second layer having a first side and a second side, said second layer of a second width, said second layer having a second layer first side edge; and said second width greater than said first width;

an intermediate layer permeable to said free-flowing permeating substance, said intermediate layer composed of a plurality of sufficiently rigid fibers, said intermediate layer intermediate said first layer and said second layer, said first layer adhering to an intermediate layer first side, said second layer first side adhering to an intermediate layer second side, said intermediate layer of said first width, and said intermediate layer having an intermediate layer first side edge;

said first layer first side edge, said intermediate layer first side edge and said second layer first side edge being aligned;

at least one piping adapted to pass through said structure, said piping adapted for communication with said first layer to permit injection of said free-flowing permeating substance into said first layer;

said piping having an inlet adapted for placement exterior said structure and constructed to permit communication with a controllable source of said free-flowing permeating substance;

a first fluid dispensing mechanism being located proximate a first layer bottom edge; and a second fluid dispensing mechanism being located proximate a first layer top edge.

8. The device of claim 7, wherein said free-flowing permeating substance comprises at least one selection from the group consisting of:

a liquid; and a gas.

9. The device of claim 7, further comprising:

an adhesive on said second side of said second layer.

10. The device of claim 7, wherein said sufficiently rigid fibers are of sufficient rigidity to maintain a void between said first layer and said second layer.

11. A device for introducing a free-flowing permeating substance to a structure in situ, the structure having thickness, said device comprising:

a first layer, said first layer being permeable to said free-flowing permeating substance but at least nearly impermeable to structural construction materials, said first layer adapted for placement adjacent said structure, said first layer adapted to communicate with said structure to permit introduction of said free-flowing permeating substance to said structure;

a second layer, said second layer being impermeable, said second layer having a first side and a second side;

an intermediate layer permeable to said free-flowing permeating substance, said intermediate layer including a plurality of sufficiently rigid fibers, said intermediate layer intermediate said first layer and said second layer, said first layer adhering to an intermediate layer first side, said second layer first side adhering to an intermediate layer second side;

at least one piping adapted to pass through said structure, said piping adapted for communication with said first layer to permit injection of said free-flowing permeating substance into said first layer; and said piping having an inlet adapted for placement exterior said structure and constructed to permit communication with a controllable source of said free-flowing permeating substance.

12. The device of claim 11, wherein said sufficiently rigid fibers are of sufficient rigidity to maintain a void between said first layer and said second layer.

* * * * *

UNITED STATES PATENT AND TRADEMARK OFFICE

CERTIFICATE OF CORRECTION

PATENT NO. : 7,584,581 B2
APPLICATION NO. : 11/066927
DATED : September 8, 2009
INVENTOR(S) : Brian Iske It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 834 days.

Signed and Sealed this

Fourteenth Day of December, 2010

David J. Kappos

David J. Kappos
*Director of the United States Patent and Trademark Office*